US006659581B2

(12) United States Patent
Schloeman et al.

(10) Patent No.: US 6,659,581 B2
(45) Date of Patent: Dec. 9, 2003

(54) INTEGRATED PROGRAMMABLE FIRE PULSE GENERATOR FOR INKJET PRINTHEAD ASSEMBLY

(75) Inventors: Dennis J. Schloeman, Corvallis, OR (US); Jeffrey S. Beck, Corvallis, OR (US); Michael J. Barbour, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/761,407

(22) Filed: Jan. 16, 2001

(65) Prior Publication Data

US 2002/0093544 A1 Jul. 18, 2002

Related U.S. Application Data

(63) Continuation-in-part of application No. 09/755,226, filed on Jan. 5, 2001, now Pat. No. 6,585,339.

(51) Int. Cl.[7] ..... B41J 29/38
(52) U.S. Cl. ..... 347/9; 347/10; 347/180
(58) Field of Search ..... 347/9, 10, 11, 347/12, 50, 180, 181, 182, 211

(56) References Cited

U.S. PATENT DOCUMENTS

| | | | | |
|---|---|---|---|---|
| 4,437,752 A | * | 3/1984 | Akashi et al. | 354/289 |
| 4,463,359 A | | 7/1984 | Ayata et al. | |
| 4,595,935 A | | 6/1986 | Brooks et al. | |
| 4,596,995 A | * | 6/1986 | Yamakawa et al. | 346/160 |
| 4,695,853 A | | 9/1987 | Hackleman et al. | |
| 4,695,854 A | | 9/1987 | Cruz-Uribe | |
| 4,719,477 A | | 1/1988 | Hess | |
| 4,764,659 A | | 8/1988 | Minami et al. | 219/216 |
| 4,982,199 A | | 1/1991 | Dunn | |
| 4,989,224 A | | 1/1991 | Narahara et al. | 377/39 |
| 4,999,650 A | | 3/1991 | Braun | |
| 5,016,023 A | | 5/1991 | Chan et al. | |
| 5,030,971 A | | 7/1991 | Drake et al. | |
| 5,049,898 A | | 9/1991 | Arthur et al. | |

(List continued on next page.)

FOREIGN PATENT DOCUMENTS

| | | | |
|---|---|---|---|
| EP | 0547921 A2 | 6/1993 | B41J/2/175 |
| EP | 0592221 A1 | 4/1994 | |
| EP | 0674993 A2 | 10/1995 | |
| EP | 1029674 A2 | 8/2000 | |
| EP | 1031421 A1 | 8/2000 | |
| EP | 1080898 A2 | 3/2001 | |
| JP | 07242004 | 3/1994 | B41J/2/30 |
| JP | 08127140 | 10/1994 | B41J/2/30 |

OTHER PUBLICATIONS

Allen, Ross R., "Ink Jet Printing with Large Pagew ide Arrays: Issues and Challenges," Recent Progress in Ink Jet Technologies II, Chapter 2, pp. 114–120.

A copy of European Search Report of Application No. EP 02 25 0006 mailed on Apr. 22, 2003 (3 pages).

A copy of European Search Report for Application No. EP 03 25 2564 mailed on Aug. 13, 2003 (3 pages).

*Primary Examiner*—Stephen D. Meier
*Assistant Examiner*—Lam Nguyen

(57) ABSTRACT

An inkjet printhead assembly includes at least one inkjet printhead having nozzles and firing resisters. The inkjet printhead assembly includes fire pulse generator circuitry responsive to a start fire signal to generate fire signals, each having a series of fire pulses. The fire pulse generator circuitry generates the fire signals by controlling the initiation and duration of the fire pulses. The fire pulses control timing and activation of electrical current through the firing resisters to thereby control ejection of ink drops from the nozzles. One embodiment of the inkjet printhead assembly includes multiple printheads disposed on a carrier to form a wide-array inkjet printhead assembly.

42 Claims, 6 Drawing Sheets

U.S. PATENT DOCUMENTS 5,057,854 A 10/1991 Pond et al.
5,079,189 A 1/1992 Drake et al. ..... 437/209
5,098,503 A 3/1992 Drake ..... 156/299
5,103,246 A 4/1992 Dunn
5,160,945 A 11/1992 Drake
5,327,165 A 7/1994 Elliott
5,363,134 A 11/1994 Barbehenn et al. ..... 347/49
5,365,312 A 11/1994 Hillmann et al. ..... 355/206
5,371,530 A 12/1994 Hawkins et al. ..... 347/9
5,541,629 A 7/1996 Saunders et al. ..... 347/12
5,604,513 A 2/1997 Takahashi et al. ..... 345/153
5,610,635 A 3/1997 Murray et al. ..... 347/7
5,646,660 A * 7/1997 Murray ..... 347/59
5,648,804 A 7/1997 Keefe et al. ..... 347/47
5,684,518 A * 11/1997 Nobel et al. ..... 347/50
5,696,544 A 12/1997 Komuro ..... 347/50
5,719,605 A 2/1998 Anderson et al. ..... 347/59
5,742,305 A 4/1998 Hackleman ..... 347/42
5,751,302 A 5/1998 Rezanka
5,755,024 A 5/1998 Drake et al. ..... 29/611
5,803,628 A * 9/1998 Donahue ..... 400/279
5,815,172 A 9/1998 Moh ..... 347/14
5,815,180 A 9/1998 Barbour et al. ..... 347/59
5,867,183 A * 2/1999 Cornell et al. ..... 347/13
5,886,718 A 3/1999 Johnson et al. ..... 347/85
5,946,012 A 8/1999 Courian et al. ..... 47/63
5,975,667 A 11/1999 Moriguchi et al.
6,002,420 A 12/1999 Tanioka et al.
6,091,891 A 7/2000 Overall et al. ..... 395/112
6,109,716 A 8/2000 Takahashi ..... 347/11
6,126,261 A 10/2000 Yamanaka ..... 347/12
6,178,009 B1 1/2001 Yamada et al. ..... 358/1.9
6,186,611 B1 2/2001 Shiraishi et al.
6,193,345 B1 2/2001 Feinn et al. ..... 347/12
6,290,333 B1 * 9/2001 Wade et al. ..... 347/50
6,312,079 B1 11/2001 Anderson et al.
6,318,847 B1 11/2001 Wade

* cited by examiner

INTEGRATED PROGRAMMABLE FIRE PULSE GENERATOR FOR INKJET PRINTHEAD ASSEMBLY

CROSS-REFERENCE TO RELATED APPLICATIONS

This Non-Provisional Patent Application is a Continuation-in-Part of U.S. Patent Application Ser. No. 09/755,226 "MODULE MANAGER FOR WIDE-ARRAY INKJET PRINTHEAD ASSEMBLY" filed on Jan. 5, 2001, now U.S. Pat No. 6,585,339, which is herein incorporated by reference.

THE FIELD OF THE INVENTION

The present invention relates generally to inkjet printheads, and more particularly to generation of fire signals for controlling ejection of ink drops from printheads.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resisters. Heating the ink causes the ink to vaporize and be ejected from the nozzles. Typically, for one dot of ink, a remote printhead controller typically located as part of the processing electronics of a printer, controls the timing and activation of an electrical current from a power supply external to the printhead with a fire pulse. The electrical current is passed through a selected thin film resister to heat the ink in a corresponding selected vaporization chamber.

In one type of inkjet printing system, printheads receive fire signals containing fire pulses from the electronic controller. In one arrangement, the fire signal is fed directly to the nozzles in the printhead. In another arrangement, the fire signal is latched in the printhead, and the latched version of the fire signal is fed to the nozzles to control the ejection of ink drops from the nozzles.

In either of the above two arrangements, the electronic controller of the printer maintains control of all timing related to the fire signal. The timing related to the fire signal primarily refers to the actual width of the fire pulse and the point in time at which the fire pulse occurs. The electronic controller controlling the timing related to the fire signal works well for printheads capable of printing only a single column at a time, because such printheads only need one fire signal to the printhead to control the ejection of ink drops from the printhead.

One proposed printhead has the capability of printing multiple columns of the same color or multiple columns of different colors simultaneously.

In one arrangement, commonly referred to as a wide-array inkjet printing system, a plurality of individual printheads, also referred to as printhead dies, are mounted on a single carrier. In one proposed arrangement, a wide-array inkjet printing system includes printheads which have the capability of printing multiple columns of the same color or multiple columns of different colors simultaneously. In any of these arrangements, a number of nozzles and, therefore, an overall number of ink drops which can be ejected per second is increased. Since the overall number of drops which can be ejected per second is increased, printing speed can be increased with a wide-array inkjet printing system and/or printheads having the capability of printing multiple columns simultaneously.

The energy requirements of different printheads and/or different print columns can possibly require a different fire pulse width for each printhead and/or print column due to processing/manufacturing variability. In this case, the number of fire signals necessary for the inkjet printing system increases significantly. For example, a 4-color integrated printhead requires four fire signals in order to independently control each color. If six of the example 4-color integrated printheads are disposed on a single carrier to form a print bar array in a wide-array inkjet printing system, the number of required fire signals increases to 24.

For reasons stated above and for other reasons presented in greater detail in the Description of the Preferred Embodiment section of the present specification, a wide-array inkjet printing system and/or a printhead having the capability of printing multiple columns is desired which minimizes the number of fire signals provided from the electronic controller to the printhead(s).

SUMMARY OF THE INVENTION

One aspect of the present invention provides an inkjet printhead including nozzles, firing resisters, and fire pulse generator circuitry. The fire pulse generator circuitry is responsive to a start fire signal to generate a plurality of fire signals. Each fire signal has a series of fire pulses, and the fire pulse generator circuitry generates the fire signals by controlling the initiation and duration of the fire pulses. The fire pulses control timing and activation of electrical current through the firing resisters to thereby control ejection of ink drops from the nozzles.

In one embodiment, the fire pulse generator circuitry includes counters. Each counter is responsive to the initiation of a corresponding fire pulse to count to a corresponding count value representing the duration of the corresponding fire pulse. In one embodiment, the fire pulse generator circuitry further includes pulse width registers for holding pulse width values. The counters are each preloaded with a corresponding pulse width value and respond to the initiation of the corresponding fire pulse to count down from the corresponding pulse width value to determine the duration of the corresponding fire pulse. In one embodiment, the fire pulse generator circuitry includes controllers controlling corresponding counters. Each controller provides a corresponding fire pulse and activates a start signal to the corresponding counter to initiate the count. Each counter activates a stop signal to the corresponding controller to terminate the corresponding fire pulse when the count value is reached.

In one embodiment, the fire pulse generator circuitry includes a start fire detection circuit receiving the start fire signal and verifying that a valid active start fire signal is received. In one embodiment, the start fire detection circuit receives a clock signal having active transitions and verifies that the valid active start fire signal is received by requiring that the active start fire signal is present for at least two of the active transitions of the clock signal.

In one embodiment, an active start fire signal is provided to the fire pulse generator circuitry each time a fire pulse is generated. In another embodiment, an active start fire signal is provided to the fire pulse generator circuitry only at the beginning of a print swath.

In one embodiment, the fire pulse generator circuitry also controls dead-time between fire pulses in the series of fire pulses in each fire signal. In one embodiment, the fire pulse generator circuitry includes dead-time counters. Each dead-time counter is responsive to a termination of a corresponding fire pulse to count to a corresponding dead-time count value representing the duration of the dead-time between fire pulses. In one embodiment, the fire pulse generator circuitry further includes dead-time registers for holding dead-time values. The dead-time counters are each preloaded with a corresponding dead-time value and respond to the termination of the corresponding fire pulse to count down from the corresponding dead-time value to determine the dead-time between fire pulses.

One aspect of the present invention provides an inkjet printhead assembly including at least one printhead. Each printhead includes nozzles and firing resisters. The inkjet printhead assembly includes fire pulse generator circuitry responsive to a first start fire signal to generate a plurality of fire signals. Each fire signal has a series of fire pulses, and the fire pulse generator circuitry generates the fire signals by controlling the initiation and duration of the fire pulses. The fire pulses control timing and activation of electrical current through the firing resisters to thereby control ejection of ink drops from the nozzles.

In one embodiment, the first start fire signal is provided from a printer controller located external from the inkjet printhead assembly. In one embodiment, the inkjet printhead assembly includes a carrier, N printheads disposed on the carrier, and a module manager disposed on the carrier. In one embodiment, the module manager receives a second start fire signal from a printer controller located external from the inkjet printhead assembly and provides the first start fire signal representing the first start signal to each of the N printheads.

One aspect of the present invention provides an inkjet printhead assembly including, a carrier, N printheads disposed on the carrier, and a module manager disposed on the carrier. Each printhead includes nozzles and firing resisters. The module manager includes fire pulse generator circuitry responsive to a start fire signal to generate a plurality of fire signals. Each fire signal has a series of fire pulses, and the fire pulse generator circuitry generates the fire signals by controlling the initiation and duration of the fire pulses. The fire pulses control timing and activation of electrical current through the firing resisters to thereby control ejection of ink drops from the nozzles of the printheads.

One aspect of the present invention provides an inkjet printing system including a printer controller providing a start fire signal. The inkjet printing system includes an inkjet printhead assembly having at least one printhead and fire pulse generator circuitry. Each printhead includes nozzles and firing resisters. The fire pulse generator circuitry is responsive to the start fire signal to generate a plurality of fire signals. Each fire signal has a series of fire pulses, and the fire pulse generator circuitry generates the fire signals by controlling the initiation and duration of the fire pulses. The fire pulses control timing and activation of electrical current through the firing resisters to thereby control ejection of ink drops from the nozzles.

One aspect of the present invention provides a method of inkjet printing including receiving a start fire signal at a printhead assembly, which includes at least one printhead having nozzles and firing resisters. The method includes generating, in response to the start fire signal, a plurality of fire signals, each having a series of fire pulses, by controlling the initiation and duration of the fire pulses internal to the printhead assembly. The method includes controlling timing and activation of electrical current through the firing resisters to thereby control ejection of ink drops from the nozzles based on the fire pulses.

An inkjet printhead/printhead assembly according to the present invention can provide different fire pulse widths for different printheads and/or print columns to accommodate the energy requirements of different printheads and/or different print columns resulting from processing/manufacturing variability without increasing the number of fire signals from the printer controller to the printhead/printhead assembly. One embodiment of the fire pulse generator circuitry according to the present invention only requires one start fire conductor between the printer controller and the printhead/printhead assembly.

Thus, the printhead/printhead assembly containing fire pulse generator circuitry according to the present invention can significantly reduce the following: the number of fire signal conductive paths to and from the printhead/printhead assembly; the number of drivers in the electronic controller necessary to transmit the fire signals from the electronic controller to the printhead assembly; and the number of pads required on the printhead/printhead assembly to receive the fire signals. Furthermore, in one embodiment having multiple printheads disposed on a carrier to form a printhead assembly and having the fire pulse generator circuitry internal to the printheads, the wiring complexity of the carrier is reduced.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
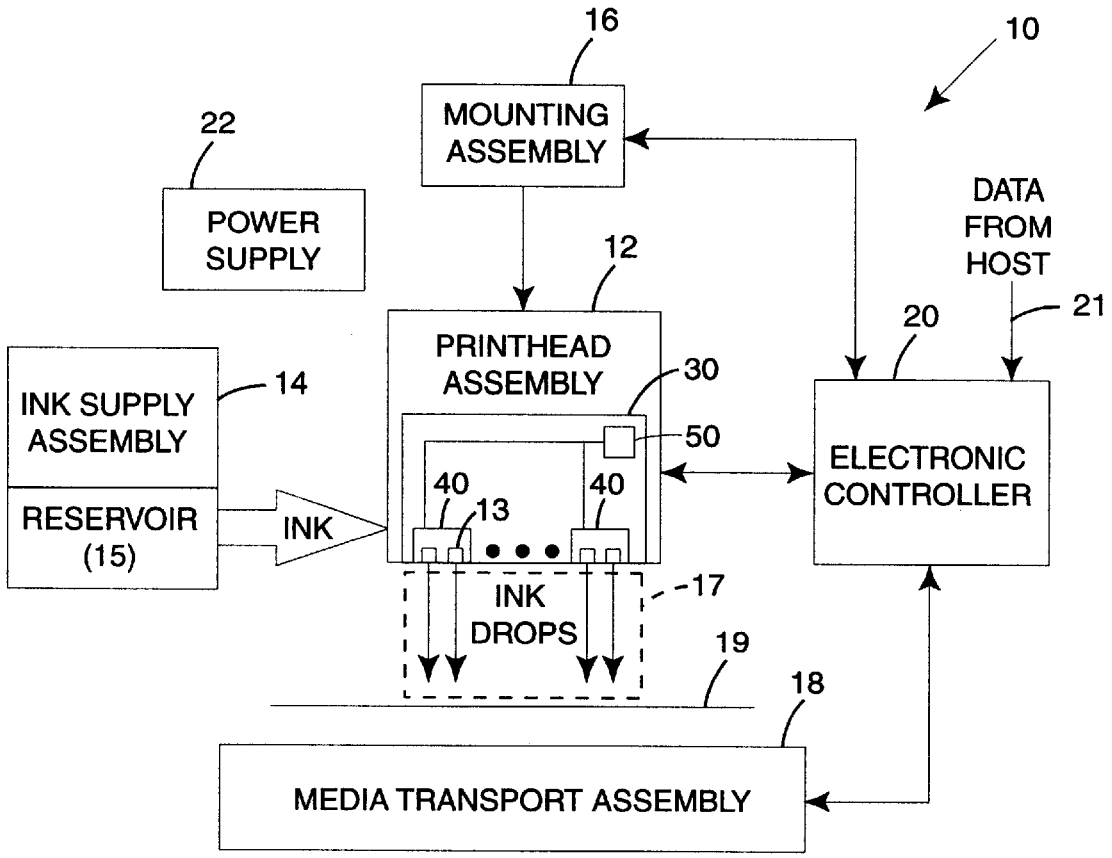
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 40 which ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, logic and drive circuitry are incorporated in a module manager integrated circuit (IC) 50 located on inkjet printhead assembly 12. Module manger IC 50 is similar to the module manager IC discussed in the above incorporated parent patent application entitled "MODULE MANAGER FOR WIDE-ARRAY INKJET PRINTHEAD ASSEMBLY." Electronic controller 20 and module manager IC 50 operate together to control inkjet printhead assembly 12 for ejection of ink drops from nozzles 13. As such, electronic controller 20 and module manager IC 50 define a pattern of ejected ink drops which form characters, symbols, and/or other graphics or images on print medium 19. The pattern of ejected ink drops, is determined by the print job commands and/or command parameters.

In one embodiment, inkjet printhead assembly 12 is a wide-array or multi-head printhead assembly. In one embodiment, inkjet printhead assembly 12 includes a carrier 30, which carries printhead dies 40 and module manager IC 50. In one embodiment carrier 30 provides electrical communication between printhead dies 40, module manager IC 50, and electronic controller 20, and fluidic communication between printhead dies 40 and ink supply assembly 14.

Figure 2:
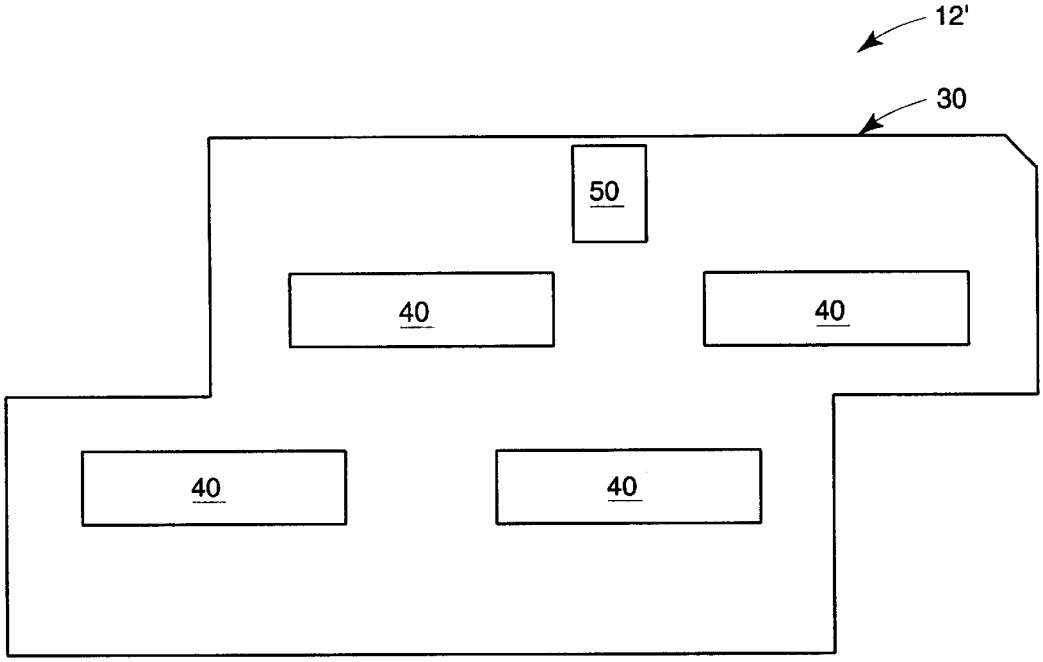
FIG. 2 is a diagram of one embodiment of an inkjet printhead subassembly or module according to the present invention.

In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead sub-assemblies or modules 12' (illustrated in FIG. 2) form one inkjet printhead assembly 12. The inkjet printhead modules 12' are substantially similar to the above described printhead assembly 12 and each have a carrier 30 which carries a plurality of printhead dies 40 and a module manager IC 50. In one embodiment, the printhead assembly 12 is formed of multiple inkjet printhead modules 12' which are mounted in an end-to-end manner and each carrier 30 has a staggered or stair-step profile. As a result, at least one printhead die 40 of one inkjet printhead module 12' overlaps at least one printhead die 40 of an adjacent inkjet printhead module 12'.

Figure 3:
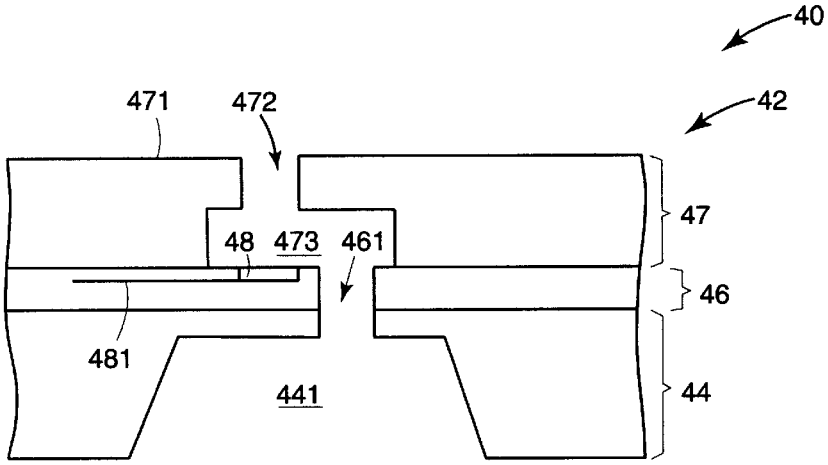
FIG. 3 is an enlarged schematic cross-sectional view illustrating portions of a one embodiment of a printhead die in the printing system of FIG. 1.

A portion of one embodiment of a printhead die 40 is illustrated schematically in FIG. 3. Printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

In one embodiment, at least one printhead 40 of printhead assembly 12 is implemented as a printhead having the capability of printing multiple columns of the same color or multiple columns of different colors simultaneously.

Printhead assembly 12 can include any suitable number (N) of printheads 40, where N is at least one. Before a print operation can be performed, data must be sent to printhead 40. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Figure 4:
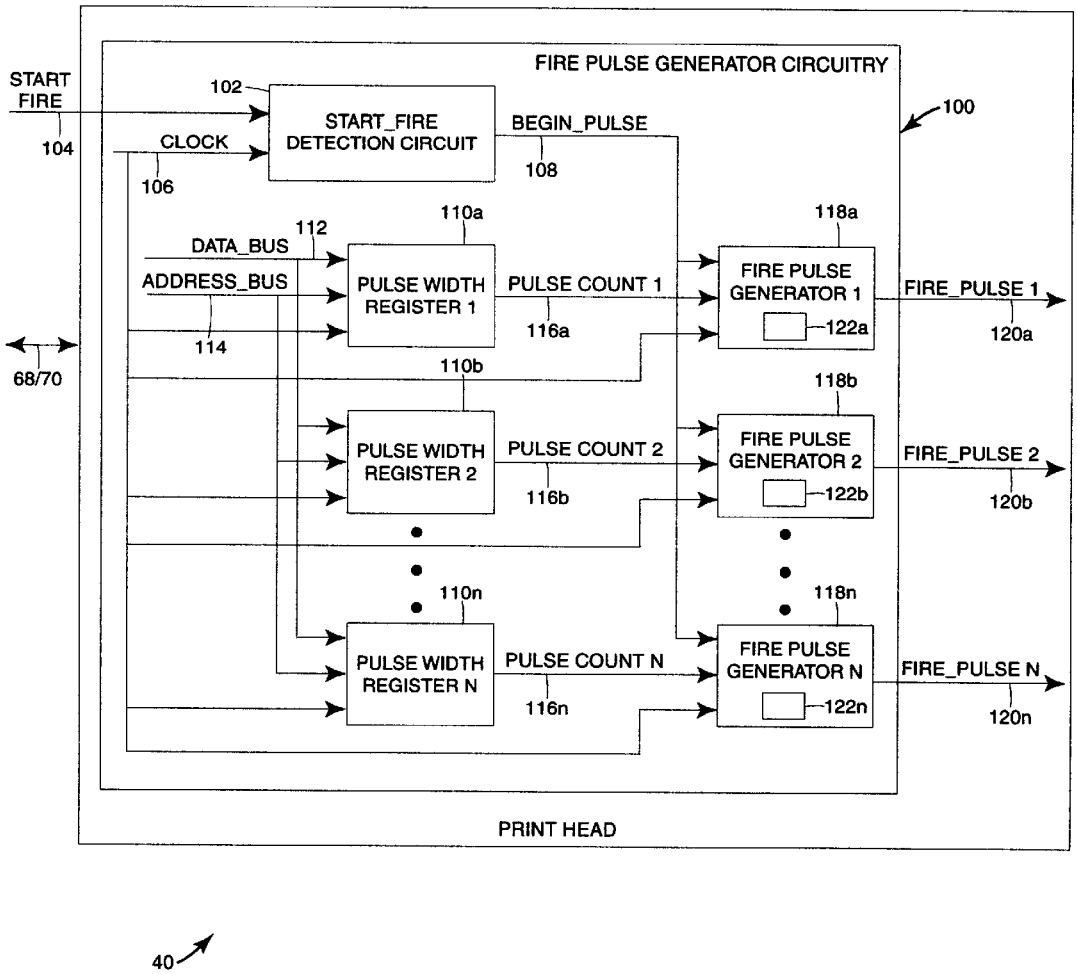
FIG. 4 is a block diagram illustrating a portion of one embodiment of an inkjet printhead having fire pulse generator circuitry according to the present invention.

A portion of one embodiment of a printhead 40 is illustrated generally in FIG. 4 in block diagram form. As discussed in the Background of the Invention section of the present specification, conventional inkjet printing systems typically employ an electronic controller remote from the printhead to control the timing and activation of an electrical current from a power supply external to the printhead with a fire signal to thereby control the ejection of ink drops from the printhead. In the conventional inkjet printing system, printheads receive fire signals containing fire pulses from the electronic controller. By contrast, printhead 40 generally illustrated in FIG. 4, includes integrated programmable fire pulse generators for generating fire signals containing fire pulses for controlling ejection of ink drops from printhead 40.

Fire pulse generator circuitry 100 includes a start_fire detection circuit 102 which receives a start_fire signal on a line 104 from electronic controller 20 or module manager IC 50. Start_fire detection circuit 102 also receives a clock signal on line 106. Start_fire detection circuit 102 verifies when a valid active start_fire signal is received on line 104. Start_fire detection circuit 102 prevents a spurious transition on the start_fire signal on line 104 from causing a fire pulse to be generated at an improper or undesired time.

In one embodiment, start_fire detection circuit 102 verifies that a valid active start_fire signal is received on line 104 by requiring that the active start_fire signal on line 104 be present for two active transitions of the clock signal on line 106 to be considered a valid active start_fire signal. There are, however, many suitable validations methods which can be employed by start_fire detection circuit 102 to verify that the start_fire signal on line 104 indicates a valid active start_fire signal.

In response to the start_fire detection circuit 102 validating that the active start_fire signal on line 104 is properly received, the start_fire detection circuit 102 activates a begin_pulse signal on a line 108.

Fire pulse generator circuitry 100 includes N pulse width registers 110*a*, 110*b*, . . . , 110*n*. Pulse width registers 110*a*–110*n* receive data on data_bus 112 and addresses from address_bus 114. The clock on line 106 is also provided to pulse width registers 110*a*–110*n*. Pulse width registers 110*a*–110*n* store pulse width values which are employed to determine the widths of the fire pulses provided from fire pulse generator circuitry 100. Pulse width registers 110*a*–110*n* respectively provide pulse counts 1, 2, . . . , N on busses 116*a*, 116*b*, . . . , 116*n*, which represent the corresponding pulse width values stored in pulse width registers 110*a*–110*n*. Each pulse width register 110*a*–110*n* stores an appropriate number of bits in the pulse width value to properly encode the desired width of the corresponding fire pulse from fire pulse generator circuitry 100.

Fire pulse generator circuitry 100 includes N fire pulse generators 118*a*, 118*b*, . . . , 118*n* corresponding to pulse width registers 110*a*–110*n* respectively. Fire pulse generators 118*a*–118*n* all receive the begin_pulse signal on line 108 from start_fire detection circuit 102 and the clock signal on line 106. In addition, fire pulse generators 118*a*–118*n* receive the pulse counts 1-N on busses 116*a*–116*n* respectively. Fire pulse generators 118*a*–118*n* respectively provide the fire signals fire_pulse_1, fire_pulse_2, . . . , fire_pulse_N respectively on lines 120*a*, 120*b*, . . . , 120*n*.

In one embodiment, each fire pulse generator 118*a*–118*n* includes a counter which is controlled by the corresponding pulse count signal on the corresponding bus 116. In one example embodiment, fire pulse generators 118*a*–118*n* respectively include binary countdown counters 122*a*, 122*b*, . . . , 122*n*. In this example embodiment, the respective binary countdown counter 122 is preloaded with the pulse width value stored in the corresponding pulse width register 110 and provided as the pulse count signal on the corresponding bus 116.

In one embodiment, the pulse width value stored in each pulse width register 110 is given by the following Equation I.

Equation I $$(\text{Pulse Width Value})=(\text{Desired Pulse Width})\times(\text{Clock Frequency})$$

Electronic controller 20 of inkjet printing system 10 can access pulse width registers 110*a*–110*n* in the same manner that electronic controller 20 accesses the other registers in printhead 40 via data_bus 112 and address bus 114. Thus, no extra control circuitry is required to implement the pulse width registers 110*a*–110*n*. In one embodiment, command data from electronic controller 20 which is independent of nozzle data is provided to and status data read from printhead 40 over a serial bi-directional non-print data serial bus 68. In another embodiment, module manger IC 50 communicates with electronic controller 20 over serial bi-directional non-print data serial bus 68, and module manager IC 50 writes command data to and reads status data from printheads 40 over serial bi-directional CS data line 78. In either embodiment, electronic controller 20 can access pulse width registers 110*a*–110*n* via bi-directional non-print data serial bus 68 which communicates serial data to and from data_bus 112 and address_bus 114.

Figure 5:
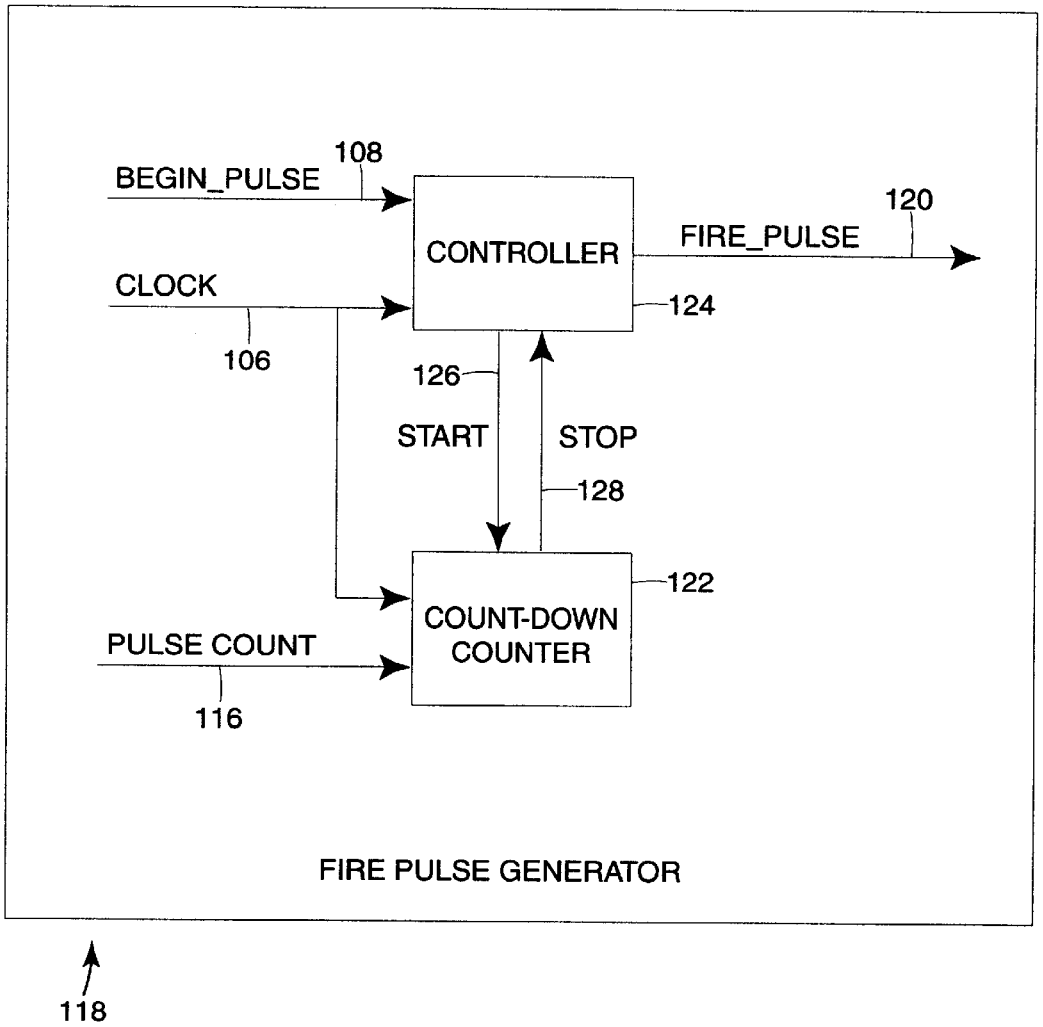
FIG. 5 is a block diagram illustrating a fire pulse generator employed by the fire pulse generator circuitry of FIG. 4.

One embodiment of a fire pulse generator 118 is illustrated in block diagram form in FIG. 5. Fire pulse generator 118 includes binary countdown counter 122 and a controller 124. Countdown counter 122 receives the pulse count from bus 116 which provides the pulse width value from the corresponding pulse width register 110 for preloading countdown counter 122.

Controller 124 receives the begin_pulse signal on line 108 and the clock signal on line 106. The clock signal on line 106 is also provided to countdown counter 122. Controller 124 provides the fire_pulse signal on line 120. Controller 124 also provides a start signal to countdown counter 122 on line 126. Countdown counter 122 correspondingly provides a stop signal on a line 128 to controller 124. The fire_pulse signal on line 120 is provided to control the ejection of ink drops from nozzles of printhead 40.

In one embodiment, controller 124 includes state machines which control the generation of a properly timed fire_pulse signal on line 120. Controller 124 accepts the active begin_pulse signal from the start_fire detection circuit 102 and accordingly initiates a fire_pulse on line 120. When controller 124 initiates the fire_pulse on line 120, controller 124 also activates the start signal on line 126 to initiate a timing function of countdown counter 122 for timing the duration of the fire_pulse on line 120. Controller 124 controls the preloading of countdown counter 122 with the pulse count on bus 116, which represents the pulse width value from pulse width register 110. Controller 124 terminates the fire_pulse on line 120 in response to receiving an activated stop signal on line 128 from countdown counter 122.

Countdown counter 122 functions as a timing circuit to ensure that the fire_pulse generated on line 120 by controller 124 is of a proper duration. One embodiment of countdown counter 122 is a binary countdown counter which is preloaded with the pulse width value from pulse width register 110. Upon receipt of an activated start signal on line 126 from controller 124, countdown counter 122 begins to countdown. In one example embodiment, when the count value stored in countdown counter 122 reaches zero, countdown counter 122 activates the stop signal on line 128, and controller 124 correspondingly responds to the activated stop signal to terminate the fire_pulse on line 120.

In the above-described embodiments illustrated in FIGS. 4 and 5, electronic controller 20 or module manager IC 50 is required to activate the start_fire signal each time a corresponding fire_pulse is generated by the fire pulse generators 118. Accordingly, in the above described embodiments, electronic controller 20 and/or module manager 50 is required to maintain control of when the fire_pulses actually occur.

Figure 6:
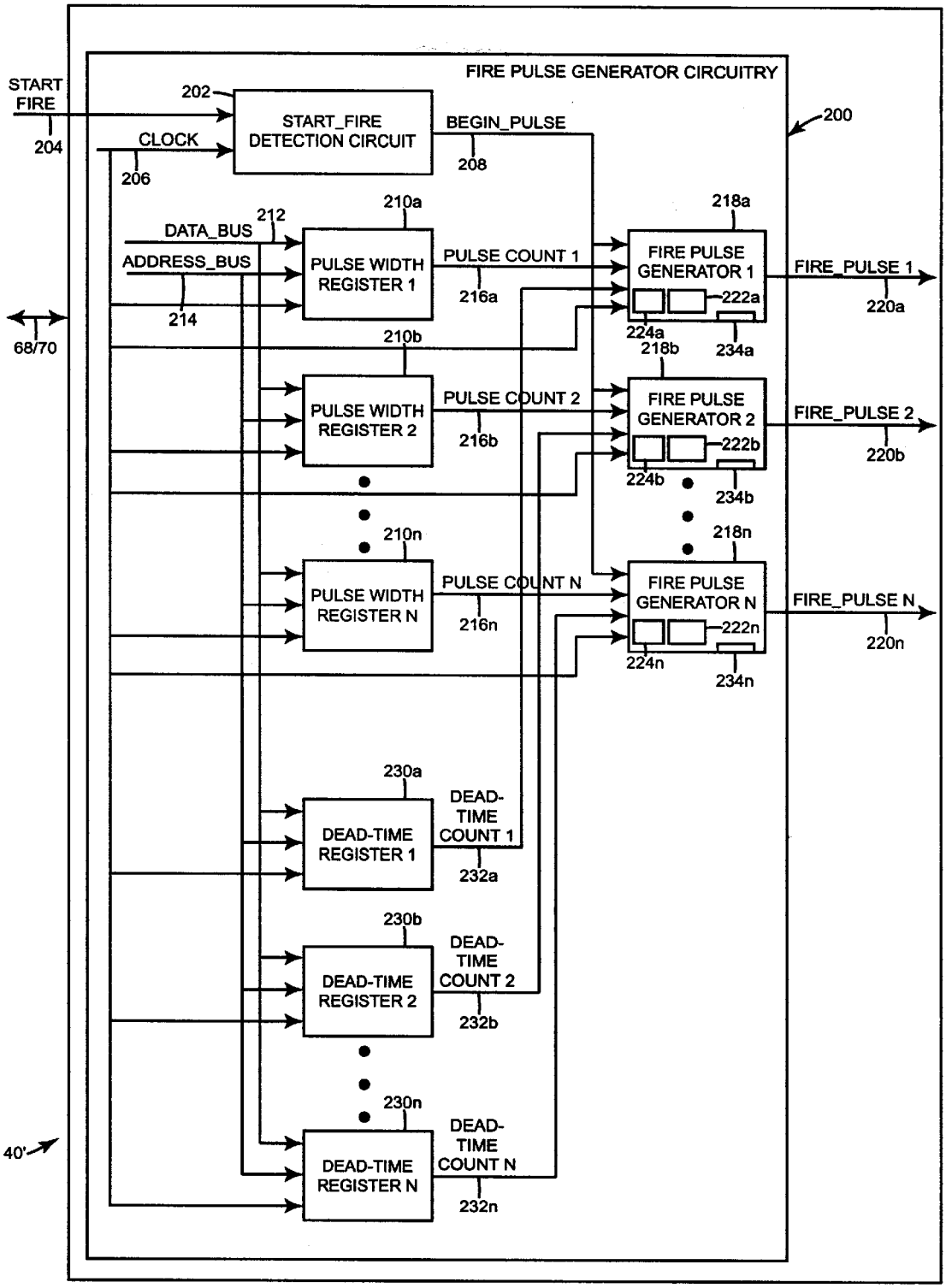
FIG. 6 is a block diagram illustrating a portion of one embodiment of an inkjet printhead having an alternative embodiment of fire pulse generator circuitry according to the present invention.

A portion of an alternative embodiment printhead 40' having alternative embodiment fire_pulse generator circuitry 200 is illustrated in block diagram form in FIG. 6. Fire pulse generator circuitry 200 automatically generates fire_pulses having the proper duration and also automatically generates the proper dead time between fire pulses in a series of fire pulses in each fire signal.

Fire pulse generator circuitry 200 includes a start_fire detection circuit 202 receiving a start_fire signal on a line 204 and a clock signal on a line 206. Start_fire detection circuit 202 functions substantially similar to the start_fire detection circuit 102 of fire pulse generator circuitry 100 and accordingly activates a begin_pulse signal on a line 208 after verifying that a valid active start_fire signal on line 204 has been provided from electronic controller 20 or module manager IC 50. However, the start_fire signal on line 204 need only be activated by electronic controller 20 or module manager IC 50 at the beginning of a print swath rather than maintaining control of when each of the fire_pulses actually occur. Thus, the begin_pulse signal is also only activated in response to a valid activated start_fire signal at the beginning of a print swath.

Fire pulse generator circuitry 200 includes pulse width registers 210*a*–210*n* receiving data on data_bus 212, addresses on address_bus 214, and the clock on line 206. The pulse width registers 210*a*–210*n* hold pulse width values corresponding to the desired pulse widths of the fire_pulses generated by fire pulse generator circuitry 200. The pulse width registers 210*a*–210*n* function substantially similar to the pulse width registers 110*a*–110*n* of fire pulse generator circuitry 100 and accordingly provide pulse count signals 1-N on corresponding busses 216*a*–216*n*, which represent the pulse width values.

In addition to the pulse width registers 210*a*–210*n*, fire pulse generator circuitry 200 includes N dead-time registers 230*a*, 230*b*, . . . , 230*n* which also receive data from data_bus 212, addresses from address_bus 214, and the clock on line 206. The dead-time registers 230*a*–230*n* store N dead-time values which represent proper dead times between fire_pulses. Dead-time registers 230*a*–230*n* accordingly provide dead-time counts on busses 232*a*, 232*b*, . . . , 230*n*, which represent the dead-time values.

Fire pulse generator circuitry 200 also includes fire pulse generators 218*a*, 218*b*, . . . , 218*n*. Fire pulse generators 218*a*–218*n* include corresponding binary countdown counters 222*a*, 222*b*, . . . , 222*n*, which are preloaded with the pulse width values represented by the pulse counts provided from pulse width registers 210*a*–210*n* on busses 216*a*–216*n*. Countdown counters 222*a*–222*n* are substantially similar to countdown counters 122*a*–122*n* of fire pulse generators 118*a*–118*n*. Fire pulse generators 218*a*–218*n* also include corresponding dead-time binary countdown counters 234*a*, 234*b*, . . . , 234*n*. Dead-time countdown counters 234*a*–234*n* are preloaded with the dead-time values from dead-time registers 230*a*–230*n* provided as the dead-time counts on busses 232*a*–232*n*.

Fire pulse generators 218*a*–218*n* each include a controller 224 which functions similar to controller 124 of fire pulse generator 118 in controlling countdown counters 222*a*–222*n*. However, controller 224 also controls the dead-time countdown counters 234*a*–234*n*. Controller 224 accordingly provides the proper width of the fire_pulses based on the timing function provided by countdown counter 222. In addition, controller 224 provides the proper dead time between fire_pulses based on the timing function provided by dead-time countdown counter 234. In one embodiment, controller 224 includes state machines which respond to countdown counter 222 and dead-time countdown counter 234 to generate fire_pulses of proper duration with proper dead time between fire pulses, which are provided as fire_pulse signals fire_pulse_1, fire_pulse_2, . . . , fire_pulse_N on lines 220*a*, 220*b*, . . . , 220*n* to control the ejection of ink drops from the printhead nozzles.

In each fire pulse generator 218, the dead-time countdown counter 234 is reset by controller 224 at the end of each fire_pulse generated by the fire pulse generator 218 and is initiated at this time to begin counting down from the preloaded dead-time value provided from the corresponding dead-time register 230 to automatically generate the proper dead time between fire pulses. In this way, fire pulse generator circuitry 200 maintains control of when the individual fire pulses from fire pulse generators 218 actually occur, and fire pulse generator circuitry 200 only needs to be initiated with a start_fire signal activation from electronic controller 20 or module manager IC 50 at the beginning of a print swath.

Figure 7:
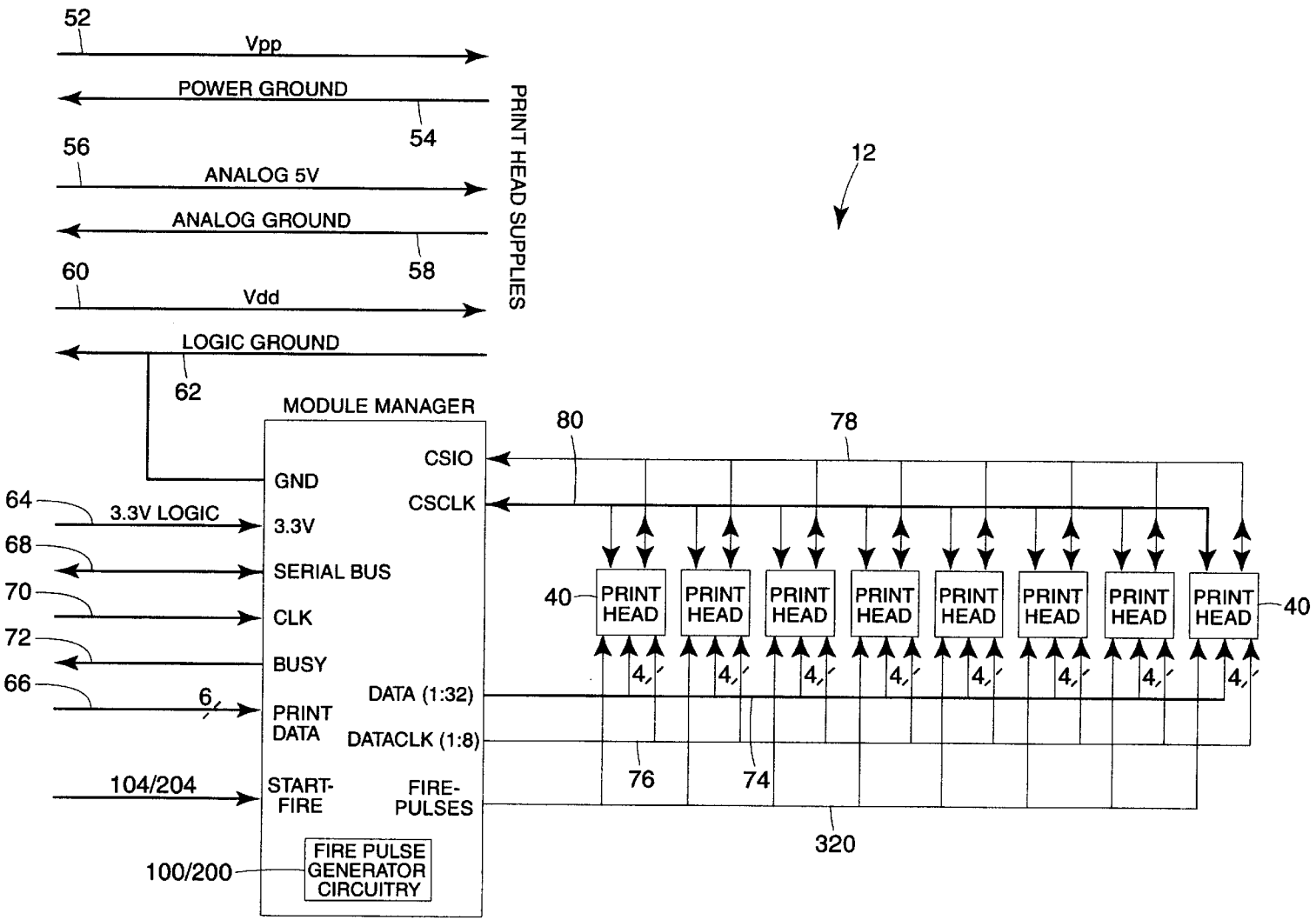
FIG. 7 is a block diagram illustrating a portion of an inkjet printhead having fire pulse generator circuitry according to the present invention.

A portion of one embodiment of an inkjet printhead assembly 12 is illustrated generally in FIG. 7. Inkjet printhead assembly 12 includes complex analog and digital electronic components. Thus, inkjet printhead assembly 12 includes printhead power supplies for providing power to the electronic components within printhead assembly 12. For example, a Vpp power supply 52 and corresponding power ground 54 supply power to the firing resisters in printheads 40. An example 5-volt analog power supply 56 and corresponding analog ground 58 supply power to the analog electronic components in printhead assembly 12. An example 5-volt logic supply 60 and a corresponding logic ground 62 supply power to logic devices requiring a 5-volt logic power source. A 3.3-volt logic power supply 64 and the logic ground 62 supply power to logic components requiring a 3.3-volt logic power source, such as module manager 50. In one embodiment, module manager 50 is an application specific integrated circuit (ASIC) requiring a 3.3-volt logic power source.

In the example embodiment illustrated in FIG. 7, printhead assembly 12 includes eight printheads 40. Printhead assembly 12 can include any suitable number (N) of printheads. Before a print operation can be performed, data must be sent to printheads 40. Data includes, for example, print data and non-print data for printheads 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Module manager IC 50 according to the present invention receives data from electronic controller 20 and provides both print data and non-print data to the printheads 40. For each printing operation, electronic controller sends nozzle data to module manager IC 50 on a print data line 66 in a serial format. The nozzle data provided on print data line 66 may be divided into two or more sections, such as even and odd nozzle data. In the example embodiment illustrated in FIG. 7, serial print data is received on print data line 66 which is 6 bits wide. The print data line 66 can be any suitable number of bits wide.

Independent of nozzle data, command data from electronic controller 20 may be provided to and status data read from printhead assembly 12 over a serial bi-directional non-print data serial bus 68.

A clock signal from electronic controller 20 is provided to module manager IC 50 on a clock line 70. A busy signal is provided from module manager IC 50 to electronic controller 20 on a line 72.

Module manager IC 50 receives the print data on line 66 and distributes the print data to the appropriate printhead 40 via data line 74. In the example embodiment illustrated in FIG. 7, data line 74 is 32 bits wide to provide four bits of serial data to each of the eight printheads 40. Data clock signals based on the input clock received on line 70 are provided on clock line 76 to clock the serial data from data line 74 into the printheads 40. In the example embodiment illustrated in FIG. 7, clock line 76 is eight bits wide to provide clock signals to each of the eight printheads 40.

Module manager IC 50 writes command data to and reads status data from printheads 40 over serial bi-directional CS data line 78. A CS clock is provided on CS clock line 80 to clock the CS data from CS data line 78 to printheads 40 and to module manager 50.

In the example embodiment of inkjet printhead assembly 12 illustrated in FIG. 7, the number of conductive paths in the print data interconnect between electronic controller 20 and inkjet printhead assembly 12 is significantly reduced, because an example module manager IC (e.g., ASIC) 50 is capable of much faster data rates than data rates provided by current printheads. For one example printhead design and example module manager ASIC 50 design, the print data interconnect is reduced from 32 pins to six lines to achieve the same printing speed, such as in the example embodiment of inkjet printhead assembly 12 illustrated in FIG. 7. This reduction in the number of conductive paths in the print data interconnect significantly reduces costs and improves reliability of the printhead assembly and the printing system.

In addition, module manager IC 50 can provide certain functions that can be shared across all the printheads 40. In this embodiment, the printhead 40 can be designed without certain functions, such as memory and/or processor intensive functions, which are instead performed in module manager IC 50. In addition, functions performed by module manager IC 50 are more easily updated during testing, prototyping, and later product revisions than functions performed in printheads 40.

Moreover, certain functions typically performed by electronic controller 20 can be incorporated into module manager IC 50. For example, one embodiment of module manager IC 50 monitors the relative status of the multiple printheads 40 disposed on carrier 30, and controls the printheads 40 relative to each other, which otherwise could only be monitored/controlled relative to each other off the carrier with the electronic controller 20.

In one embodiment, module manager IC 50 permits standalone printheads to operate in a multi-printhead printhead assembly 12 without modification. A standalone printhead is a printhead which is capable of being independently coupled directly to an electronic controller. One example embodiment of printhead assembly 12 includes standalone printheads 40 which are directly coupled to module manger IC 50.

As illustrated in FIG. 7, one embodiment of module manager IC 50 includes fire pulse generator circuitry, such as fire pulse generator circuitry 100 described above and illustrated in FIGS. 4 and 5 or fire pulse generator circuitry 200 described above and illustrated in FIG. 6. The fire pulse generator circuitry in module manager IC 50 operates substantially similar to the fire pulse generator circuitry in the printhead 40 illustrated in FIG. 4 or the printhead 40' illustrated in FIG. 6, except that the fire_pulses are no longer generated in the printheads 40, and therefore, need to be provided to the printheads 40 on lines 320 (shown in FIG. 7).

Thus, fire pulse generator circuitry 100/200 receives the start_fire signal on line 104/204 and verifies when a valid active start_fire signal is received. Fire pulse generator circuitry 100/200 responds to the validated active start_fire signal to initiate fire_pulses on lines 320 of proper duration. In addition, as described above, in the fire pulse generator circuitry 200 embodiment, the dead_time between fire_pulses is also provided by fire pulse generator circuitry 200.

In the printhead embodiments illustrated in FIGS. 4–6, the fire pulse generator circuitry is contained within the printhead which enables the printhead to automatically generate fire pulses of proper duration. In the embodiment illustrated in FIG. 7, the printhead assembly 12 via module manager IC 50 automatically generates the fire pulses of proper duration. In any of these embodiments, electronic controller 20 of inkjet printing system 10 according to the present invention does not need to generate the individual fire pulses. In addition, in the alternative embodiment of fire pulse generator circuitry 200 illustrated in FIG. 6, the proper dead time between fire pulses is generated in the printhead 40 or module manager IC 50 so that electronic controller 20 of the inkjet printing system according to the present invention does not need to maintain control of when the fire pulses actually occur.

As discussed in the Background of the Invention section, the energy requirements of different printheads and/or different print columns can possibly require a different fire pulse width for each printhead and/or print column due to processing/manufacturing variability. In this case, the number of fire signals necessary for the inkjet printing system increases significantly. In such a system, the fire pulse generator circuitry according to the present invention, such as fire pulse generator circuitry 100 or 200, only requires one start_fire conductor between electronic controller 20 and the printhead/printhead assembly. Thus, the printhead/printhead assembly containing fire pulse generator circuitry according to the present invention can significantly reduce the number of fire signal conductive paths to and from the printhead/printhead assembly.

In an example printhead assembly having eight 4-slot color printheads on a common carrier, the number of required fire signals is reduced from 32 to 1 with the fire pulse generator circuitry according to the present invention. This not only significantly reduces the number of fire signal conductors necessary in the electrical interconnect between the electronic controller and the printhead assembly, but also significantly reduces the number of drivers in the electronic controller necessary to transmit the fire signals from the electronic controller to the printhead assembly. In addition, the fire pulse generator circuitry according to the present invention also significantly reduces the number of pads required on the printhead/printhead assembly to receive the fire signals. The reduced number of fire signal conductors in the electrical interconnect between the electronic controller and the printhead assembly correspondingly reduces the amount of undesirable electromagnetic interference (EMI) conducted through the fire signal conductors. Moreover, in the embodiment where there are multiple printheads mounted on a carrier to form a printhead assembly, and the fire pulse generator circuitry is internal to the printheads, the wiring complexity of the carrier is reduced.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead comprising:

nozzles;

firing resistors; and fire pulse generator circuitry including a start fire detection circuit receiving a start fire signal and verifying that a valid active start fire signal is received and pulse width registers for holding pulse width values, and responsive to at least one valid active start fire signal to generate a plurality of fire signals, each having a series of fire pulses, by controlling the initiation and duration of the fire pulses, wherein the duration of the fire pulses is based on the pulse width values, wherein each fire pulse controls timing and activation of electrical current through selected firing resistors to thereby control ejection of ink drops from the nozzles.

2. The inkjet printhead of claim 1 wherein the fire pulse generator circuitry comprises:

counters, each responsive to the initiation of a corresponding fire pulse to count to a corresponding count value representing the duration of the corresponding fire pulse.

3. The inkjet printhead of claim 2 wherein the fire pulse generator circuitry further comprises:

pulse width registers for holding pulse width values, wherein the counters are each preloaded with a corresponding pulse width value and respond to the initiation of the corresponding fire pulse to count down from the corresponding pulse width value to determine the duration of the corresponding fire pulse.

4. The inkjet printhead of claim 2 wherein the fire pulse generator circuitry further comprises:

controllers controlling corresponding counters, each controller providing a corresponding fire pulse and activating a start signal to the corresponding counter to initiate the count, and wherein each counter activates a stop signal to the corresponding controller to terminate the corresponding fire pulse when the count value is reached.

5. The inkjet printhead of claim 1 wherein the start fire detection circuit receives a clock signal having active transitions and verifies that the valid active start fire signal is received by requiring that the active start fire signal is present for at least two of the active transitions of the clock signal.

6. The inkjet printhead of claim 1 wherein an active start fire signal is provided to the fire pulse generator circuitry prior to each time a fire pulse is generated.

7. The inkjet printhead of claim 1 wherein an active start fire signal is provided to the fire pulse generator circuitry only at the beginning of a print swath.

8. The inkjet printhead of claim 1 wherein the fire pulse generator circuitry also controls dead-time between fire pulses in the series of fire pulses in each fire signal.

9. The inkjet printhead of claim 8 wherein the fire pulse generator circuitry comprises:

dead-time registers for holding dead-time values, wherein the dead-time between fire pulses is based on the dead-time values.

10. The inkjet printhead of claim 8 wherein the fire pulse generator circuitry comprises:

dead-time counters, each responsive to a termination of a corresponding fire pulse to count to a corresponding dead-time count value representing the duration of the dead-time between fire pulses.

11. The inkjet printhead of claim 10 wherein the fire pulse generator circuitry further comprises:

dead-time registers for holding dead-time values, wherein the dead-time counters are each preloaded with a corresponding dead-time value and respond to the termination of the corresponding fire pulse to count down from the corresponding dead-time value to determine the dead-time between fire pulses.

12. An inkjet printhead assembly comprising:

a carrier:

N printheads disposed on the carrier, each printhead including:

nozzles;

firing resistors; and fire pulse generator circuitry including a start fire detection circuit receiving a first start fire signal and verifying that a valid active first start fire signal is received and responsive to at least one valid active first start fire signal to generate a plurality of fire signals, each having a series of fire pulses, by controlling the initiation and duration of the fire pulses, wherein each fire pulse controls timing and activation of electrical current through selected firing resistors to thereby control ejection of ink drops from the nozzles; and a module manager disposed on the carrier and receiving a second start fire signal from a printer controller located external from thc inkjet printhead assembly and providing the first start fire signal representing the second start fire signal to each of the N printheads.

13. The inkjet printhead assembly of claim 12, wherein the first start fire signal is provided from a printer controller located external from the inkjet printhead assembly.

14. The inkjet printhead assembly of claim 12 wherein the module manager is adapted to receive a serial input data stream and corresponding input clock signal from the printer controller located external from the inkjet printhead assembly and to demultiplex the serial data stream into N serial output data streams and to provide the N serial output data streams and N corresponding output clock signals based on the input clock signal to the N printheads.

15. The inkjet printhead assembly of claim 12, wherein the module manager is implemented in an integrated circuit.

16. An inkjet printhead assembly, comprising:

a carrier;

N printheads disposed on the carrier, each printhead including nozzles and firing resistors; and a module manager disposed on the carrier and including:

fire pulse generator circuitry including a start fire detection circuit receiving a start fire signal and verifying that a valid active start fire signal is received and responsive to at least one valid active start fire signal to generate a plurality of fire signals, each having a series of fire pulses, by controlling the initiation and duration of the fire pulses, wherein each fire pulse controls timing and activation of electrical current through selected firing resistors to thereby control ejection of ink drops from the nozzles of the printheads; and wherein the module manager is adapted to receive a serial input data stream and corresponding input clock signal from a printer controller located external from the inkjet printhead assembly and to demultiplex the serial data stream into N serial output data streams and to provide the N serial output data streams and N corresponding output clock signals based on the input clock signal to the N printheads.

17. The inkjet printhead assembly of claim 16, wherein the start fire signal is provided from a printer controller located external from the inkjet printhead assembly.

18. The inkjet printhead assembly of claim 16, wherein the module manager is implemented in an integrated circuit.

19. An inkjet printhead assembly, comprising:

multiple inkjet printhead modules, each inkjet printhead module including:

a carrier;

N printheads disposed on the carrier, each printhead including nozzles firing and resistors;

fire pulse generator circuitry including a start fire detection circuit receiving a first start fire signal and verifying that a valid active first start fire signal is received and responsive to at least one valid active first start fire signal to generate a plurality of fire signals, each having a series of fire pulses, by controlling the initiation and duration of the fire pulses, wherein each fire pulse controls timing and activation of electrical current through selected firing resistors to thereby control ejection of ink drops from the nozzles; and a module manager disposed on the carrier and adapted to receive a serial input data stream and corresponding input clock signal from a printer controller located external from the inkjet printhead assembly and to demultiplex the serial data stream into N serial output data streams and to provide the N serial output data streams and N corresponding output clock signals based on the input clock signal to the N printheads, and wherein the module manager includes the fire pulse generator circuitry.

20. The inkjet printhead assembly of claim 19 wherein the fire pulse generator circuitry is integrated into each printhead.

21. A method of operating a printhead assembly comprising:

receiving a start fire signal at a printhead assembly, which includes at least one printhead having nozzles and firing resistors;

verifying that a valid active start fire signal is received;

holding pulse width values;

generating, in response to at least one valid active start fire signal, a plurality of fire signals, each having a series of fire pulses, by controlling the initiation and duration of the fire pulses internal to the printhead assembly including determining the duration of the fire pulses based on the pulse width values; and controlling, with each fire pulse, timing and activation of electrical current through selected firing resistors to thereby control ejection of ink drops from the nozzles.

22. The method of claim 21 wherein receiving the start fire signal, verifying that a valid active start fire signal is received, generating the plurality of fire signals, and controlling timing and activation of electrical current through selected firing resistors are all performed in each printhead.

23. The method of claim 21 further comprising:

receiving, at a module manager disposed on a carrier, a serial input data stream and a corresponding input clock signal from a printer controller located external from the carrier;

demultiplexing, at the module manager, the serial data stream into N serial output data streams;

providing, from the module manager, the N serial output data streams and N corresponding output clock signals based on the input clock signal to N printheads disposed on the carrier; and wherein receiving the start fire signal, verifying that a valid active start fire signal is received, generating the plurality of fire signals, and controlling timing and activation of electrical current through selected firing resistors are all performed in the module manager.

24. The method of claim 21 further comprising:

counting to a count value in response to the initiation of a corresponding fire pulse, wherein the count value represents the duration of the corresponding fire pulse.

25. The method claim 24 further comprising:

activating a start signal to initiate the counting step; and activating a stop signal to terminate the corresponding fire pulse when the count value is reached.

26. The method of claim 21 further comprising:

receiving a clock signal at the printhead assembly, wherein the clock signal has active transitions; and verifying that a valid active start fire signal is received by requiring that the active start fire signal is present for at least two of the active transitions of the clock signal.

27. The method of claim 21 wherein the receiving step comprises:

receiving an active start fire signal at the printhead assembly prior to each time a fire pulse is generated.

28. The method of claim 21 wherein the receiving step comprises:

receiving an active start fire signal at the printhead assembly only at the beginning of a print swath.

29. The method of claim 21 further comprising:

controlling dead-time between fire pulses in the series of fire pulses in each fire signal.

30. The method of claim 29 further comprising:

holding dead-time values; and determining the dead-time between fire pulses based on the dead-time values.

31. The method of claim 29 further comprising:

counting to a dead-time count value in response to a termination of a corresponding fire pulse, wherein the dead-time count value represents the duration of the dead-time between fire pulses.

32. A fluid ejection device comprising:

nozzles;

firing resistors; and fire pulse generator circuitry including a start fire detection circuit receiving a start fire signal and verifying that a valid active start fire signal is received and pulse width registers for holding pulse width values, and responsive to at least one valid active start fire signal to generate a plurality of fire signals, each having a series of fire pulses, by controlling the initiation and duration of the fire pulses, wherein the duration of the fire pulses is based on the pulse width values, wherein each fire pulse controls timing and activation of electrical current through selected firing resistors to thereby control ejection of fluid drops from the nozzles.

33. The fluid ejection device of claim 32 wherein the fire pulse generator circuitry comprises:

counters, each responsive to the initiation of a corresponding fire pulse to count to a corresponding count value representing the duration of the corresponding fire pulse.

34. The fluid ejection device of claim 33 wherein the fire pulse generator circuitry further comprises:

pulse width registers for holding pulse width values, wherein the counters are each preloaded with a corresponding pulse width value and respond to the initiation of the corresponding fire pulse to count down from the corresponding pulse width value to determine the duration of the corresponding fire pulse.

35. The fluid ejection device of claim 33 wherein the fire pulse generator circuitry further comprises:

controllers controlling corresponding counters, each controller providing a corresponding fire pulse and activating a start signal to the corresponding counter to initiate the count, and wherein each counter activates a stop signal to the corresponding controller to terminate the corresponding fire pulse when the count value is reached.

36. The fluid ejection device of claim 32 wherein the start fire detection circuit receives a clock signal having active transitions and verifies that the valid active start fire signal is received by requiring that the active start fire signal is present for at least two of the active transitions of the clock signal.

37. The fluid ejection device of claim 32 wherein an active start fire signal is provided to the fire pulse generator circuitry prior to each time a fire pulse is generated.

38. The fluid ejection device of claim 32 wherein an active start fire signal is provided to the fire pulse generator circuitry only at the beginning of a selected firing sequence.

39. The fluid ejection device of claim 32 wherein the fire pulse generator circuitry also controls dead-time between fire pulses in the series of fire pulses in each fire signal.

40. The fluid ejection device of claim 39 wherein the fire pulse generator circuitry comprises:

dead-time registers for holding dead-time values, wherein the dead-time between fire pulses is based on the dead-time values.

41. The fluid ejection device of claim 39 wherein the fire pulse generator circuitry comprises:

dead-time counters, each responsive to a termination of a corresponding fire pulse to count to a corresponding dead-time count value representing the duration of the dead-time between fire pulses.

42. The fluid ejection device of claim 41 wherein the fire pulse generator circuitry further comprises:

dead-time registers for holding dead-time values, wherein the dead-time counters are each preloaded with a corresponding dead-time value and respond to the termination of the corresponding fire pulse to count down from the corresponding dead-time value to determine the dead-time between fire pulses.

* * * * *